US005338616A

United States Patent [19]

Ishii et al.

[11] Patent Number: 5,338,616

[45] Date of Patent: Aug. 16, 1994

[54] FAR-INFRARED EMITTER OF HIGH EMISSIVITY AND CORROSION RESISTANCE AND METHOD FOR THE PREPARATION THEREOF

[75] Inventors: Kazuhide Ishii; Tatsuo Kawasaki, both of Chiba; Noriyuki Kuriyama, Hyogo; Shoji Dohi, Osaka; Akio Nakashiba, Osaka; Souhei Miyazaki, Osaka, all of Japan

[73] Assignees: Kawasaki Steel Corporation, Kyogo; Osaka Gas Co., Ltd., Osaka, both of Japan

[21] Appl. No.: 47,613

[22] Filed: Apr. 8, 1993

Related U.S. Application Data

[63] Continuation of Ser. No. 371,083, Jun. 26, 1989, abandoned.

[30] Foreign Application Priority Data

Jul. 26, 1988 [JP] Japan ..... 63-184630
Jul. 26, 1988 [JP] Japan ..... 63-184631

[51] Int. Cl.[5] ..... C22C 38/22

[52] U.S. Cl. ..... 428/472; 219/552; 420/37; 420/43; 420/50; 420/442; 428/469; 428/472.1; 428/472.2

[58] Field of Search ..... 428/469, 472, 472.1, 428/472.2; 219/552; 420/37, 43, 50, 442

[56] References Cited

U.S. PATENT DOCUMENTS

| | | | |
|---|---|---|---|
| 2,191,790 | 2/1940 | Franks | 148/286 |
| 4,086,085 | 4/1978 | McGurty | 420/43 |
| 4,124,737 | 11/1978 | Wolfla et al. | 428/640 |
| 4,149,910 | 4/1979 | Popplewell | 428/433 |
| 4,348,241 | 9/1982 | Kunioka et al. | 428/472.2 |
| 4,429,019 | 1/1984 | Schrewelius | 428/629 |
| 4,470,848 | 9/1984 | Natesan et al. | 420/442 |
| 4,487,744 | 12/1984 | DeBold et al. | 428/582 |
| 4,742,324 | 5/1988 | Shida et al. | 148/327 |
| 4,802,894 | 2/1989 | Usami et al. | 420/50 |
| 4,822,689 | 4/1989 | Fukubayashi et al. | 428/472 |

FOREIGN PATENT DOCUMENTS

| | | |
|---|---|---|
| 0034133 | 8/1981 | European Pat. Off. . |
| 0091526 | 10/1983 | European Pat. Off. . |
| 0290719 | 1/1988 | European Pat. Off. . |
| 2093073A | 8/1982 | United Kingdom . |

*Primary Examiner*—A. A. Turner
*Attorney, Agent, or Firm*—Oliff & Berridge

[57] ABSTRACT

A far-infrared emitter of high corrosion resistance is prepared by an oxidizing heat treatment of a body made from a stainless steel of 20–35% by weight of chromium, 0.5–5.0% by weight of molybdenum, up to 3.0% by weight of manganese and up to 3.0% by weight of silicon at 900°–1200° C. to form an oxidized surface film having a thickness of at least 0.2 mg/cm$^2$. Further, a far-infrared emitter of a high emissivity approximating a black body is prepared by subjecting a body made from a stainless steel of 10–35% by weight of chromium, 1.0–4.0% by weight of silicon and up to 3.0% by weight of manganese to a blasting treatment to roughen the surface followed by an oxidizing heat treatment at 900°–1200° C. to form an oxide film on the surface in the form of protrusions having a length of at least 5 μm.

7 Claims, 1 Drawing Sheet

FAR-INFRARED EMITTER OF HIGH EMISSIVITY AND CORROSION RESISTANCE AND METHOD FOR THE PREPARATION THEREOF

This is a continuation of application Ser. No. 07/371,083 filed Jun. 26, 1989, now abandoned.

BACKGROUND OF THE INVENTION

The present invention relates to a far-infrared emitter of high emissivity and corrosion resistance and a method for the preparation thereof. More particularly, the invention relates to a stainless steel-made far-infrared emitter having a high emissivity approximating that of a black body and excellent corrosion resistance suitable as a heater element in room heaters and drying or heating apparatuses utilizing far-infrared rays as well as a method for the preparation thereof.

As is well known, far-infrared rays have a characteristic of easily penetrating human bodies and various kinds of organic materials so that room heaters utilizing far-infrared rays are advantagesous in respect of the high efficiency of heat absorption in the depth of the human body and far-infrared drying or heating ovens can be advantageously used for drying of paintcoated surfaces or heating of various kinds of food by virtue of the rapidness of heating.

Several metal oxides such as zirconium oxide, aluminum oxide, silicon dioxide and titanium dioxide are known to emit far-infrared rays with a high efficiency at high temperatures so that many of the, far-infrared emitters currently in use are manufactured from a ceramic material mainly composed of one or more of these metal oxides or by providing a metal-made substrate with a ceramic coating layer composed of these metal oxides. Such a ceramic-based far-infrared emitter, however, is practically defective in respect of the fragility to be readily broken by shocks and lack of versatility to the manufacture of large-sized emitters. Metal-based ceramic-coated far-infrared emitters are also not without problems because the ceramic coating layer is liable to fall during use off the substrate surface in addition to the expensiveness of such an emitter.

In view of the above mentioned problems in the ceramic-based far-infrared emitters, many proposals have been made for metal-made heat radiators of infrared emitters. For example, Japanese Patent Publication 59-7789 discloses a heat radiator made of an alloy of nickel and chromium, iron and chromium or iron, chromium and nickel provided with a black oxide film on the surface mainly composed of an oxide of chromium formed by the oxidation at a high temperature. Japanese Patent Publication 59-28959 discloses a stainless steel-made infrared heater element provided with an oxide surface film having a thickness of 1 to 10 μm formed by an oxidation treatment at a high temperature of 700° C. or higher. Japanese Patent Publication 60-1914 discloses an infrared-radiating heater element made of a highly heat resistant alloy such as incoloy and subjected to an oxidation treatment at a high temperature of 800° C. or higher. Further, Japanese Patent Kokai 55-6433 discloses a stainless steelmade radiator provided with an oxide surface film formed by a wet process after roughening of the surface to have a surface roughness of 1 to 10 μm.

While it is desirable that a far-infrared emitter has an emissivity as high as possible, the above described ceramic-based or stainless steel-based emitters have an emissivity rarely exceeding 0.9 or, in most cases, 0.8 or smaller. Far-infrared emitters usually utilize the far-infrared rays emitted from the emitter body at a temperature in the range from 100° to 500° C. As is understood from the Planck's law of radiation distribution, an emitter of low emissivity can emit a far-infrared radiation identical with that from an emitter of higher emissivity only when it is heated at a higher temperature. Needless to say, a larger energy cost is required in order to heat an emitter at a higher temperature. Moreover, certain materials are susceptible to degradation when exposed to a radiation of shorter wavelength such as near-infrared and visible rays so that heat radiators used for such a material are required to emit far-infrared rays alone and the far-infrared emitter should be kept at a relatively low working temperature not to emit radiations of shorter wavelengths. Accordingly, it is eagerly desired to develop a far-infrared emitter having a high emissivity even at a relatively low temperature.

Apart from the above described problem in the emissivity, stainless steel-made far-infrared emitters in general have another problem of relatively poor corrosion resistance. Namely, the working atmosphere of a far-infrared emitter is sometimes very corrosive. For example, a large volume of water vapor is produced when a water-base paint is dried or food is heat-treated with a far-infrared emitter to form an atmosphere of high temperature and very high humidity. When the working hours of such a heating furnace come to the end of a working day, the furnace is switched off and allowed to cool to room temperature so that the water vapor in the atmosphere is condensed to cause bedewing of the surface of the stainless steel-made far-infrared emitter. Thus, it is usually unavoidable that rusting of the stainless steel-made far-infrared emitter starts within a relatively short time as a consequence of the repeated cycles of heating and bedewing. Once rusting has started, it would be before long that scale of the rust comes off the surface to enter the food under the heat treatment or to adhere to the fabric material under drying so that the heating furnace can no longer be used without entirely replacing the far-infrared emitter elements in order to obtain acceptable products.

SUMMARY OF THE INVENTION

The present invention accordingly has an object to provide a novel far-infrared emitter free from the above described problems and disadvantages in the conventional stainless steel-made far-infrared emitters in respect of the emissivity and corrosion resistance as well as an efficient method for the preparation of such a far-infrared emitter.

Thus, the far-infrared emitter having, in an aspect of the invention, excellent corrosion resistance is a body made from a stainless steel, which is essentially consisting of: from 20 to 35% by weight of chromium; from 0.5 to 5.0% by weight of molybdenum, up to 3.0% by weight of manganese and up to 3.0% by weight of silicon, the balance being iron and unavoidable impurities, and having an oxidized surface film of a thickness corresponding to at least 0.2 mg/cm$^2$.

The above defined far-infrared emitter of the invention can be prepared by heating a body made from the above specified stainless steel in an oxidizing atmosphere at a temperature in the range from 900° C. to 1200° C. for a length of time which is at least 5 minutes when the heating temperature is 1100° C. or higher and at least (142.5-0.125 T) minutes when the heating temperature is lower than 1100° C., T being the heating temperature given in °C.

The far-infrared emitter of the invention having, in another aspect of the invention, an outstandingly high emissivity is a body made from a stainless steel, which is essentially consisting of: from 10 to 35% by weight of chromium; from 1.0 to 4.0% by weight of silicon and up to 3.0% by weight of molybdenum, the balance being iron and unavoidable impurities, and having an oxidized surface film with protrusions each having a length of at least 5 μm.

The above defined high-emissivity far-infrared emitter of the invention can be prepared by a method comprising the steps of (a) subjecting the surface of a body made from the above specified stainless steel to a blasting treatment and then (b) heating the body after the blasting treatment in an oxidizing atmosphere at a temperature in the range from 900° C. to 1200° C. for a length of time of at least 15 minutes.

DETAILED DESCRIPTION OF THE PREFERRED EMBODIMENTS

Figure 1:
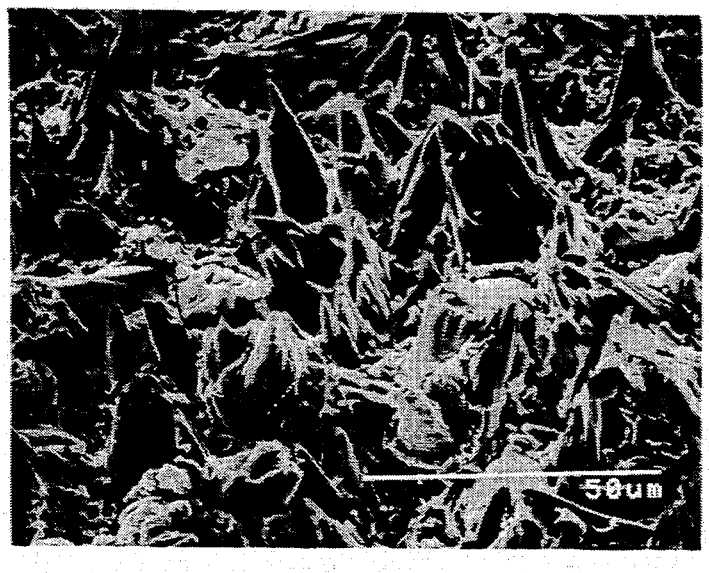
FIG. 1 is an electron microphotograph of the surface of a high-emissivity far-infrared emitter according to the invention.

The corrosion-resistant far-infrared emitter according to the first aspect of the present invention is made from a stainless steel based on iron, chromium and molybdenum as the essential alloying elements together with silicon and manganese as the optional additive elements each in a specified proportion. Such a composition of stainless steels is not novel. The amount of and the role played by each of the alloying elements in the stainless steel are as follows.

Firstly, silicon in the stainless steel has an effect to increase the oxidation resistance of the stainless steel so as to facilitate the oxidation treatment thereof at a high temperature. However, an excessive amount of silicon in the stainless steel is detrimental in respect of the decreased ductility of the material not only in the base metal but also in the welded portion. This is the reason that the amount of silicon in the stainless steel should not exceed 3.0% by weight.

Secondly, addition of manganese to the stainless steel has an effect to decrease the tenacity of the material not only in the base metal but also in the welded portion along with an adverse effect on the oxidation resistance of the stainless steel at high temperatures. Accordingly, the amount of manganese in the stainless steel should not exceed 3.0% by weight.

Thirdly, chromium is one of the essential elements in stainless steels in order that the stainless steel may have corrosion resistance. When the amount of chromium is smaller than 20% by weight, no satisfactory corrosion resistance can be imparted to the stainless steel. When the amount of chromium exceeds 35% by weight, on the other hand, the steel may have brittleness to cause difficulty in fabrication into an emitter body. This is the reason for the limitation in the amount of chromium in the range from 20 to 35% by weight.

Fourthly, molybdenum is another essential element in the stainless steel for shaping the far-infrared emitter of the invention and has an effect to improve the corrosion resistance of the stainless steel after an oxidation treatment at high temperatures. When the amount of molybdenum is smaller than 0.5% by weight, the above mentioned advantageous effect cannot be fully obtained. When the amount of molybdenum exceeds 5.0% by weight, on the other hand, the steel may have brittleness so that the steel cannot be worked into a thin plate or sheet. This is the reason for the limitation in the amount of molybdenum in the range from 0.5% to 5.0% by weight.

In addition to the above mentioned elements including chromium, molybdenum, silicon and manganese, various kinds of additive elements can be added to the stainless steel according to the established formulation of stainless steels. For example, addition of titanium, niobium or zirconium in an amount up to 0.5% by weight is effective in improving the tenacity and oxidation resistance of the stainless steel in the base metal as well as in the welded portions. Further, addition of a rare earth element such as yttrium, cerium, lanthanum, neodymium and the like in an amount up to 0.3% by weight is effective in preventing falling of the oxidized surface film off the surface of the emitter body. Addition of these auxiliary elements is of course optional in the chromium-molybdenum-based stainless steel used for shaping the far-infrared emitter of the invention.

The above defined stainless steel is fabricated into a thin plate which is subjected to a heat treatment in an oxidizing atmosphere to be provided with an oxidized surface film. The temperature of the heat treatment is in the range from 900° C. to 1200° C. When the temperature is lower than 900° C., the diffusion velocity of chromium in the steel is low from the core portion to the surface layer not to fully compensate the amount of chromium lost in the form of an oxide out of the surface so that a chromium-depletion layer having a thickness of up to several tens of micrometers is formed on the surface with consequently decreased corrosion resistance of the emitter. Such a chromium-depletion layer is not formed on the surface when the heat treatment is performed at a temperature of 900° C. or higher as a result of the increased diffusion velocity of chromium to impart the plate with high corrosion resistance. When the temperature of the heat treatment exceeds 1200° C., however, high-temperature distortion takes place in the stainless steel plate so remarkably that the plate can no longer be used as a material of the far-infrared emitter of the invention.

It is essential that the oxidized surface film formed by the heat treatment of the stainless steel plate in an oxidizing atmosphere has a thickness corresponding to a weight of at least 0.20 mg/cm$^2$ in order that the emitter may have a satisfactory emissivity of far-infrared rays. Such a thickness of the oxidized surface film can be obtained by conducting the oxidizing heat treatment for a sufficient length of time. When the temperature of the heat treatment is in the range from 900° C. to 1100° C., the length of time for the treatment must be at least (142.5-0.125 T) minutes, T being the temperature in °C., and, when the temperature is in the range from 1100° C. to 1200° C., the heat treatment must be continued for at least 5 minutes. The oxidizing atmosphere used in the oxidizing heat treatment is not limited to the atmospheric air as such but can be an oxygen-enriched gaseous mixture of oxygen and a non-oxidizng gas such as nitrogen, argon, helium and the like together with or without water vapor. Various kinds of combustion gases are also used satisfactorily for the oxidizing atmospheric gas in the inventive method.

The oxidized surface film should have a thickness corresponding to a weight of at least 0.2 mg/cm$^2$ or, preferably, in the range from 0.2 mg/cm$^2$ to 10 mg/cm$^2$ or, more preferably, in the range from 0.5 mg/cm$^2$ to 2.0 mg/cm$^2$. When the thickness is too large, the oxidized surface film may readily fall off the surface of the substrate as a trend.

It is sometimes effective to increase the surface roughness of the stainless steel plate in order to have an increased effective surface area for emission of far-infrared rays. For example, satisfactory results may be obtained with a stainless steel plate after a blasting treatment or dull rolling.

In another aspect of the invention, as is mentioned before, the present invention provides a far-infrared emitter having an outstandingly high emissivity. The far-infrared emitter of high emissivity is a body made of a specific stainless steel and having an oxidized surface film with protrusions each having a length of at least 5 μm. Such a unique oxidized surface film can be formed by subjecting the surface of a stainless steelmade base body to a blasting treatment followed by an oxidizing heat treatment at a high temperature under specific conditions.

The essential alloying elements in the stainless steel are silicon and chromium in amounts in the range from 1.0 to 4.0% by weight and in the range from 10 to 35% by weight, respectively. Silicon is an essential element in the stainless steel in order that protrusions are formed in the oxidized surface film on the surface of the base body. Namely, no protrusions can be formed in the oxidized surface film when the content of silicon in the stainless steel is lower than 1.0% by weight. When the content of silicon in the stainless steel exceeds 4.0% by weight, on the other hand, the stainless steel is somewhat brittle to cause difficulties in fabrication of plates thereof. Chromium is also an essential element in the stainless steel to impart oxidation resistance thereto. When the content of chromium is lower than 10% by weight, the steel may have insufficient oxidation resistance. When the content of chromium exceeds 35% by weight, on the other hand, the steel is somewhat brittle to cause a difficulty in fabrication into an emitter.

The stainless steel may contain manganese in addition to the above mentioned essential elements of silicon and chromium but the content of manganese should not exceed 3.0% by weight because of the adverse effects of manganese on the tenacity of the steel in the base metal and in the welded portion and on the oxidation resistance of the stainless steel at high temperatures. In addition, the stainless steel may contain up to 0.5% by weight of titanium, niobium and zirconium with an object of increasing the tenacity to facilitate fabrication and improving the oxidation resistance and up to 0.3% by weight of a rare earth element such as yttrium, cerium, lanthanum, neodymium and the like with an object of preventing falling of the oxidized surface film off the surface of the base body.

A base body of the inventive far-infrared emitter of the invention prepared by fabricating the above described stainless steel is first subjected to a blasting treatment prior to the high-temperature oxidizing treatment to impart the surface of the steel plate with a strong work strain which is essential in order that protrusions of a length of at least 5 μm are formed on the surface by the oxidation treatment. The blasting treatment is performed by projecting an abrasive powder of alumina or silicon carbide having a roughness of #100 to #400 or steel balls or steel grits having a diameter of 0.05 mm to 1.0 mm to the surface until the surface is imparted with a surface roughness of at least 0.5 μm in Ra.

The next step is a heat treatment of the thus blasting-treated base body of the emitter in an oxidizing atmosphere at a temperature in the range from 900° C. to 1200° C. for at least 15 minutes so as to form an oxidized surface film in the form of protrusions having a length of at least 5 μm whereby the surface of the emitter body is imparted with a greatly enhanced emissivity of far-infrared rays. The oxidizing atmosphere used here can be the same as in the oxidizing heat treatment of the emitter body made from the chromium-molybdenum-based stainless steel to impart enhanced corrosion resistance. The temperature in the oxidizing heat treatment should be in the range from 900° C. to 1200° C. because an oxidized surface film in the form of protrusions cannot be formed at a temperature lower than 900° C. while the base body of the emitter is subject to a high-temperature distortion at a temperature higher than 1200° C. to such an extent that it can no longer be used as a far-infrared emitter of the invention. The length of time for the heat treatment is usually at least 15 minutes at the above mentioned temperature in order that the oxidized surface film may have a form of protrusions of a sufficient length.

In the following, examples are given to illustrate the inventive far-infrared emitters in more detail.

EXAMPLE 1

Eight kinds of steels A to H were used in the tests each in the form of a plate having a thickness of 1.0 mm after annealing and pickling including six commercially available steels A, B, D, E, F and G and two laboratory-made steels C and H prepared by melting, casting and rolling. Table 1 below shows the grade names and chemical compositions of these steels.

Each of these stainless steel plates was cut by shearing into 10 cm by 10 cm square plates, referred to as the samples No. 1 to No. 12 hereinbelow, which were subjected to a surface treatment I, II or III specified below excepting for the samples No. 2, No. 5 and No. 12 followed by a high-temperature oxidizing treatment in air under the conditions shown in Table 2.

Surface treatment

I: sand blasting with #180 SiC abrasive powder

II: shot blasting with steel balls of 0.1 mm diameter

III: dull rolling, i.e. rolling with a surfaceroughened roller

TABLE 1

| | Steel No. | C | Si | Mn | Cr | Mo | Ni | Others |
|---|---|---|---|---|---|---|---|---|
| A | 30Cr2Mo | 0.003 | 0.2 | 0.1 | 30.1 | 1.9 | <0.1 | Nb 0.14 |
| B | 26Cr4Mo | 0.003 | 0.2 | 0.1 | 26.2 | 3.7 | <0.1 | Nb 0.16 |
| C | 30Cr1Mo | 0.005 | 0.4 | 0.2 | 29.2 | 0.9 | <0.1 | Ti 0.1<br>REM 0.1 |
| D | 18Cr2Mo | 0.004 | 0.1 | 0.3 | 17.8 | 1.8 | 0.3 | Nb 0.3 |
| E | SUS 430 | 0.04 | 0.4 | 0.4 | 17.4 | <0.1 | 0.2 | Ti 0.2 |
| F | SUS 304 | 0.06 | 0.5 | 1.5 | 18.5 | <0.1 | 8.2 | |
| G | Incoloy | 0.024 | 0.4 | 0.4 | 20.4 | <0.1 | 31.1 | Ti 0.3<br>Al 0.3 |
| H | 25Cr | 0.011 | 0.4 | 0.2 | 24.8 | <0.1 | <0.1 | |

The stainless steel test plates after the high-temperature oxidation treatment were subjected to the measurement of the center-line average height of surface roughness $R_a$ defined in JIS B 0601 by using a tracer-method surface roughness tester specified in JIS B 0651. The test plates were accurately weighed before and after the high-temperature oxidation treatment to determine the increment in the weight by the oxidation treatment per unit surface area. The amount of oxidation in mg/cm$^2$ shown in Table 2 is the thus obtained value after multiplication by a factor of 3.3. This is because an X-ray analysis of the

TABLE 2

| | Sample No. | Steel No. | Surface treatment | Conditions of high-temperature oxidation treatment (142.5–0.125T, minutes) | Roughness, μm | Amount of oxidation, mg/cm$^2$ | Emissivity | Corrosion resistance |
|---|---|---|---|---|---|---|---|---|
| Inventive example | 1 | A | I | 16 hours at 900° C. (30) | 0.9 | 0.3 | 0.8 | no rusting |
| | 2 | A | — | 4 hours at 1000° C. (17.5) | 0.1 | 0.6 | 0.7 | no rusting |
| | 3 | A | III | 4 hours at 1000° C. (17.5) | 1.8 | 1.0 | 0.9 | no rusting |
| | 4 | B | II | 1 hour at 1100° C. | 3.6 | 1.4 | 0.9 | no rusting |
| | 5 | C | — | 0.5 hour at 1200° C. | 0.2 | 0.8 | 0.7 | no rusting |
| Comparative example | 6 | A | I | 12 hours at 850° C. | 2.4 | 0.1 | 0.5 | rusting in part |
| | 7 | A | I | 10 minutes at 1000° C. (17.5) | 0.7 | 0.1 | 0.5 | no rusting |
| | 8 | D | II | 4 hours at 1000° C. (17.5) | 3.6 | 1.0 | 0.8 | rusting in part |
| | 9 | E | II | 4 hours at 1000° C. (17.5) | 1.8 | 2.2 | 0.9 | rusting all over |
| | 10 | F | II | 4 hours at 1000° C. (17.5) | 2.4 | 0.8* | 0.8 | rusting all over |
| | 11 | G | II | 4 hours at 1000° C. (17.5) | 1.6 | 0.3 | 0.7 | rusting in part |
| | 12 | H | — | 4 hours at 1000° C. (17.5) | 0.2 | 0.8 | 0.7 | rusting all over |

*falling of a part of oxide film oxide film on each of the test plates indicated that the oxide film had a chemical composition approximately corresponding to $Cr_2O_3$ to give a weight ratio of $Cr_2O_3$ to oxygen equal to 3.3.

In the next place, the infrared emissivity of each of the test plates was obtained as an average ratio of the intensity of infrared emission at 400° C. in the wavelength region of 5 to 15 μm to the black body emission at the same temperature in the same wavelength region. The results are shown in Table 2.

The results in Table 2 indicate the criticality of the oxidation temperature and the length of the oxidation treatment. Thus, the sample No. 6, oxidized for 12 hours at a low temperature of 850° C., and sample No. 7, oxidized at 1000° C. for a short time of 10 minutes, each had an amount of oxidation of only 0.1 mg/cm$^2$ to give an emissivity of 0.5 which should be compared with the emissivity of 0.8 and 0.7 obtained in the samples No. 1 and No. 2 prepared from the same kind of the stainless steel A. A practically acceptable emissivity of 0.7 or higher could be obtained in all of the test plates excepting No. 6 and No. 7. In this regard, dull rolling for the surface treatment was effective to give an emissivity of 0.8 or higher on the test plates having the thus roughened surface. In particular, an improvement in the productivity of the oxidation treatment was obtained by using the steel C as is shown by the sample No. 5 which could be fully oxidized at a high temperature of 1200° C. within a short time of 0.5 hour by virtue of the addition of 0.1% by weight of rare earth elements, i.e. mixture of cerium, lanthanum and neodymium, to the 30Cr1Mo steel with an object to prevent falling of the oxide film from the surface.

Finally, the salt spray test specified in JIS Z 2371 was undertaken for 4 hours to determine the corrosion resistance of the test plates to give the results shown in Table 2. As is shown there, no rusting at all was found on each of the test plates No. 1 to No. 5 according to the invention while rusting was found in part on the sample No. 6, prepared from the 30Cr2Mo steel but oxidized at a low temperature of 850° C., sample No. 8, prepared from the 18Cr2Mo steel of low chromium content of 18% by weight, and sample No. 11, prepared from incoloy, and rusting was found allover the surface on the samples No. 9, No. 10 and No. 12 prepared from SUS 430, SUS 304 and 25Cr steel, respectively.

EXAMPLE 2

Stainless steel plates having a thickness of 1.0 mm were prepared by rolling two different chromium-silicon steels I and J having a chemical composition shown in Table 3 followed by annealing and acid washing. Test plates of infrared emitters were prepared from these laboratory-made stainless steel plates I and J as well as from commercially available plates of stainless steels SUS 430 and SUS 304 (steels E and F, see Table 1) having a thickness of 1.0 mm for comparative purpose.

TABLE 3

| | Steel No. | C | Si | Mn | Cr | Ni | Others |
|---|---|---|---|---|---|---|---|
| I | 11Cr1.5Si | 0.01 | 1.5 | 0.2 | 11.2 | 0.2 | Ti 0.2 |
| J | 25Cr3Si | 0.005 | 2.9 | 2.1 | 25.1 | <0.1 | Ti 0.2 REM 0.1 |

Each of the stainless steel plates I, J, E and F was cut into 10 cm by 10 cm squares which were subjected first to a blasting treatment and then to a high-temperature oxidation treatment in air under the conditions shown in Table 4 given below. The conditions of the blasting treatments I and II shown in the table were the same as in Example 1.

Each of the test plates after the blasting treatment excepting the sample No. 16 was subjected to the measurement of the surface rougness in the same manner as in Example 1 to find a substantial increase in the surface roughness from about 0.3 μm on the plates of the steels I and J and about 0.2 μm on the plates of the steels E and F to about 1.8 to 2.9 μm on the plates after the shot blasting treatment with steel balls and about 0.8 to 1.4 μm on the plates after the blasting treatment with the silicon carbide abrasive powder.

Figure 2:
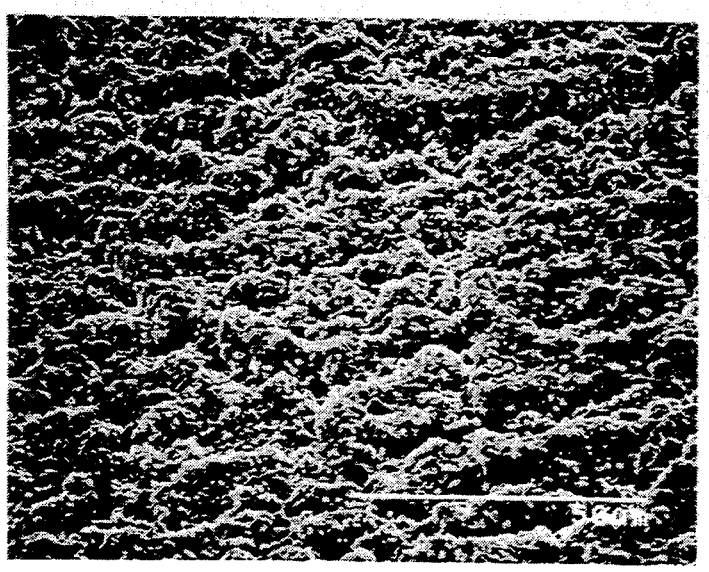
FIG. 2 is a similar electron microphotograph of a conventional stainless steel-made far-infrared emitter.

The surface condition of these test plates after the oxidation treatment was examined using an electron microscope to give the photographs of FIGS. 1 and 2 indicating the surface condition of the sample No. 13 according to the invention and the sample No. 16 for comparative purpose, respectively. Further, microphotographs of 800 magnifications were taken of the surface of the test plates inclined at an angle of 60° to estimate the length of the oxide protrusions, of which an average of the actual values was calculated and shown in Table 4. As is shown in the table, no protrusions of the oxide film were found on the sample No. 16 prepared by omitting the blasting treatment and the samples No. 18 and No. 19 prepared from the stainless steels SUS 430 and SUS 304, respectively, containing no silicon. The length of the oxide protrusions was about 3 μm on the sample No. 17 prepared by the high-temperature oxidation treatment for a relatively short time of 30 minutes. The samples No. 13 to No. 15 each had oxide protrusions of a length of at least 7 μm.

The test plates were subjected to the measurement of the emissivity in the wavelength region of 5 to 15 μm in the same manner as in Example 1 to give the results shown in Table 4. The emissivity was 0.7 to 0.9 on the samples No. 17 to No. 19 having no protrusions of the oxide film and on the sample No. 16 of which the length of the oxide protrusions was only about 3 μm while the samples No. 13 to No. 15 had a quite high emissivity of 1.0 to approximate a black body.

TABLE 4

| | Sample No. | Steel No. | Surface treatment | Conditions of high-temperature oxidation treatment | Roughness, μm | Condition of oxide film | Emissivity |
|---|---|---|---|---|---|---|---|
| Inventive example | 13 | I | I | 4 hours at 1000° C. | 0.8 | 10 μm long protrusions | 1.0 |
| | 14 | J | I | 16 hours at 950° C. | 1.4 | 7 μm long protrusions | 1.0 |
| | 15 | J | II | 0.5 hour at 1100° C. | 2.9 | 10 μm long protrusions | 1.0 |
| Comparative example | 16 | I | — | 4 hours at 1000° C. | 0.3 | smooth | 0.7 |
| | 17 | I | I | 0.5 hour at 1000° C. | 1.1 | 3 μm long protrusions | 0.8 |
| | 18 | E | II | 4 hours at 1000° C. | 1.8 | smooth | 0.9 |
| | 19 | F | II | 4 hours at 1000° C. | 2.4 | smooth, falling in part of the film | 0.8 |

What is claimed is:

1. A method of improving the corrosion resistance of far-infrared emitter comprising a body made from a stainless steel comprising from 20% to 35% by weight of chromium and a chromium oxide layer formed on the stainless steel body by high temperature oxidation treatment with a thickness corresponding to a weight of at least 0.2 mg/cm$^2$, wherein the method comprises including in the stainless steel from 0.5 to 5.0% by weight of molybdenum, up to 3.0% by weight of manganese, and up to 3.0% by weight of silicon, the balance being iron and unavoidable impurities.

2. A method of improving the emissivity of a far-infrared emitter comprising a body made from a stainless steel comprising from 10% to 35% by weight of chromium and a chromium oxide layer formed on the stainless steel body by high temperature oxidation treatment with protrusions having a length of at least 5 microns, wherein the method comprises including in the stainless steel from 1.0 to 4.0% by weight of silicon and up to 3.0% by weight of molybdenum, the balance being iron and unavoidable impurities.

3. In a far-infrared emitter comprising a body made from a stainless steel comprising from 20% to 35% by weight of chromium and a chromium oxide layer formed on the stainless steel body by high temperature oxidation treatment with a thickness corresponding to a weight of at least 0.2 mg/cm$^2$, wherein the improvement comprises the stainless steel further comprising from 0.5% to 5.0% by weight of molybdenum, up to 3.0% by weight of manganese, and up to 3.0% by weight of silicon, the balance being iron and unavoidable impurities, said improvement resulting in the far-infrared emitter being substantially rust-free.

4. The far-infrared emitter according to claim 3, wherein the far-infrared emitter is completely rust-free.

5. In a far-infrared emitter comprising a body made from a stainless steel comprising from 10% to 35% by weight of chromium and a chromium oxide layer formed on the stainless steel body by high temperature oxidation treatment with protrusions having a length of at least 5 microns, wherein the improvement comprises the stainless steel further comprising from 1.0% to 4.0% by weight of silicon and up to 3.0% by weight of molybdenum, the balance being iron and unavoidable impurities, said improvement resulting in the far-infrared emitter having an emissivity of at least 0.7.

6. A far-infrared emitter according to claim 5, wherein the far-infrared emitter has an emissivity of at least 0.8.

7. A far-infrared emitter according to claim 5, wherein the far-infrared emitter has an emissivity of at least 0.9.

* * * * *

UNITED STATES PATENT AND TRADEMARK OFFICE

CERTIFICATE OF CORRECTION

PATENT NO. : 5,338,616
DATED : August 16, 1994
INVENTOR(S) : Kazuhide Ishii, et al It is certified that error appears in the above-indentified patent and that said Letters Patent is hereby corrected as shown below:

On the title page item [73], change "Kyogo" to --Hyogo-ken--.

Signed and Sealed this

Twenty-ninth Day of November, 1994

*Attest:*

Bruce Lehman

BRUCE LEHMAN

*Attesting Officer*

*Commissioner of Patents and Trademarks*